US006162159A

United States Patent [19]

Martini et al.

[11] Patent Number: 6,162,159

[45] Date of Patent: Dec. 19, 2000

[54] TICKET DISPENSER

[76] Inventors: Calvin Duke Martini, 27 Darwin Drive, Riverview, New Brunswick, Canada, E1B 1GA; Eugene Anthony Helmetsie, 939 South Danby Rd., Spencer, N.Y. 14883

[21] Appl. No.: 09/139,306

[22] Filed: Aug. 24, 1998

[51] Int. Cl.[7] ..... B31B 1/88

[52] U.S. Cl. ..... 493/324; 493/320; 493/372

[58] Field of Search ..... 493/324, 320, 493/372; 83/23, 79, 443, 94, 149; 226/118.4, 118.5; 101/288; 400/613, 621, 611

[56] References Cited

U.S. PATENT DOCUMENTS

| | | | |
|---|---|---|---|
| 1,312,449 | 8/1919 | Lundberg . | |
| 2,395,763 | 2/1946 | Sagner | 197/66 |
| 3,308,919 | 3/1967 | Cunningham | 197/186 |
| 3,593,833 | 7/1971 | Bretti | 197/132 |
| 3,756,453 | 9/1973 | Griffioen et al. | 221/41 |
| 3,877,855 | 4/1975 | Hanson . | |
| 4,038,764 | 8/1977 | Hanson . | |
| 4,106,226 | 8/1978 | Hanson . | |
| 4,206,840 | 6/1980 | Hanson . | |
| 4,297,039 | 10/1981 | Lees | 400/120 |
| 4,301,917 | 11/1981 | Ancell | 206/39.5 |
| 4,422,376 | 12/1983 | Teraoka | 101/69 |
| 4,585,125 | 4/1986 | Mori et al. | 209/534 |
| 4,592,669 | 6/1986 | Lohse et al. | 400/621 |
| 4,695,171 | 9/1987 | Sapitowicz | 400/70 |
| 5,044,622 | 9/1991 | Cattin | 271/121 |
| 5,207,349 | 5/1993 | Kringel | 221/15 |
| 5,749,452 | 5/1998 | Hanson . | |

FOREIGN PATENT DOCUMENTS

| | | |
|---|---|---|
| 2 649 042 | 6/1989 | France . |
| 2 012 466 | 7/1979 | United Kingdom . |

*Primary Examiner*—Stephen F. Gerrity
*Assistant Examiner*—Sam Tawfik
*Attorney, Agent, or Firm*—Jefferson Perkins

[57] ABSTRACT

A ticket dispenser has a dispenser body with an internal chamber, and a lid for closing the chamber. The lid has an external ticket-receiving surface. A roll of paper or the like is contained in the chamber, and is fed between a rotating drum and an upright support surface. The lid defines a substantially upright wall with an upper edge, the wall being offset with respect to the support surface when the lid is closed. A passive retainer mechanism on the body retains against the upright wall any part of the paper web rising from between the drum and the support surface. A relatively stiff deflector bends the web material around the edge by virtue of a deflector surface located so as to be intersected by the projection of the operative part of the upright wall portion. A cutter is provided to cut the paper web into discrete tickets. Each severed ticket is retained in place by the relatively flexible retainer mechanism, so that it will be contacted by the cut marginal edge of the remaining web, due to the urging of the strip, and will achieve an overlapping frictional grip therewith so that continued upward movement of the web will eject the cut ticket from the dispenser.

38 Claims, 3 Drawing Sheets

TICKET DISPENSER

FIELD OF THE INVENTION

This invention relates generally to a ticket dispenser adapted to dispense tickets sequentially and stacked one on top of the other, with the dispensed tickets lying substantially horizontally on the top of the ticket dispenser lid.

BACKGROUND OF THE INVENTION

It can be of advantage for ticket dispensers to dispense tickets sequentially with the last ticket purchased by an individual being the last ticket output by the ticket dispenser. It can be of further advantage for the tickets to stack in the same order in which they are created, with the tickets facing the operator and with the last ticket on top. Prior art ticket dispensers of this kind have incorporated complex mechanical solutions to achieve the above.

The following four U.S. patents are of interest.

U.S. Pat. No. 4,592,669, issued Jun. 3, 1986, to Lohse et al. discloses a direct-recording printer and a housing structure therefor. The printer includes a thermo printer contacting a paper web as it is advanced by a platen. Once the web has been printed, it exits the housing along a horizontal pass beneath a cutting bar. A cutting edge on the end of the cutting bar allows the paper web to be cut.

U.S. Pat. No. 4,422,376, issued Dec. 27, 1983, Teraoka discloses a label printer to print labels on a roll. Once the labels are printed, they are ejected from the printer housing at an angle through a slot in the printer housing.

U.S. Pat. No. 3,593,833, issued Jul. 20, 1971 to Bretti, discloses a device for supporting and guiding a roll of paper in an accounting machine. The machine has a reservoir for a paper roll, with rollers in the bottom of the reservoir to facilitate rolling of the roll as the web is unwound from the roll.

U.S. Pat. No. 4,695,171, issued Sep. 22, 1987 to Sapitowicz, discloses a horizontally or vertically orientable compact ticket processor. The processor has a U-shaped transport pass with input and output slots in closely situated parallel planes. An overrunning clutch forms part of the transport drive between the reader and the printer to shorten the transport pass by permitting the leading edge of the ticket to enter the printer while the ticket is being read by the reader. In operation, individual tickets are fed into the input slot and are conveyed to the printer before being discharged via the output.

It is therefore an object of the present invention to provide a novel ticket dispenser.

SUMMARY OF THE INVENTION

Disclosed herein is a ticket dispenser to dispense tickets sequentially and in a stack, with the dispensed tickets lying horizontally on top of the ticket dispenser, and with the last ticket dispensed being on top of the stack face up. In a preferred embodiment, the ticket dispenser includes a passive mechanism to ensure that the tickets exit the ticket dispenser sequentially and stack horizontally in the same order as the printing. The ticket dispenser includes a chamber holding a roll of paper on which the tickets to be dispensed are printed. The roll of paper is fed between a drum on the dispenser lid and an internal wall on the dispenser body so that when the drum is rotated the paper web is advanced. A print head is mounted on the body above the drum, and prints ticket information on the web. A strip of flexible material projects from the body to contact the web and hold it against a vertical wall on the lid above the drum. This ensures that the ticket is supported vertically above the drum. A cutting mechanism is accommodated in the body to cut the web after a ticket has been printed. Deflector means is provided on the body near its top and above the lid to apply a horizontal force to tickets exiting the dispenser, so that the tickets assume a horizontal orientation and stack on top of the dispenser after being dispensed.

More particularly, this invention provides a ticket dispenser comprising:

- a housing defining an internal chamber for receiving a roll of paper web and having an upper ticket receiving surface;
- a paper web guide to direct a paper web unwound from a roll in said chamber along a generally vertical path toward said ticket receiving surface, said paper web guide including a substantially upright wall portion with an upper edge and a passive retainer mechanism acting on said paper web so as to retain against the upright wall portion any part of the paper web advancing along said path;
- a drive actuable to unwind said paper web from said roll and advance said paper web along said path;
- a cutting mechanism for cutting the paper web into discrete tickets; and
- a deflector oriented so as to deflect toward the ticket receiving surface any portion of the paper web rising beyond said edge.

Further, this invention provides a ticket dispenser comprising:

- a dispenser body defining an internal chamber for receiving a roll of paper web,
- a lid for the body, the lid being movable between a closed and an open position with respect to said chamber,
- an external ticket receiving surface,
- upright means on the body defining a substantially upright support surface,
- drum means mounted on the lid such that, when the lid is in its closed position, the drum means rests against said support surface,
- drive means for rotating said drum means such that, when a paper web from a roll of paper web within said chamber passes between the drum means and the support surface, rotation of the drum means causes the paper web to advance,
- the lid having a substantially upright wall portion with an upper edge, the wall portion being positioned above and generally parallel with, but offset from said support surface when the lid is closed, such that a portion of paper web coming from between the drum means and the support surface is spaced away from said upright wall portion,
- said edge being located substantially adjacent said ticket receiving surface, a relatively stiff deflector means supported from said body and having an operative deflector surface adapted and oriented so as to deflect toward the ticket receiving surface any portion of the paper web rising beyond said edge,
- a relatively flexible retainer supported from said body and resting against the upright wall portion and shaped so as to deflect toward the upright wall portion any part of the paper web coming from between the drum means and the support surface, and
- a cutting means for cutting the paper web into discrete tickets each having a leading and a trailing edge, thus ensuring that the trailing edge of each severed ticket will be retained by the retainer until it is contacted by the leading edge of the next sequential ticket, achieves an overlapping frictional grip therewith, and is ejected from the dispenser.

In addition, this invention provides a method of printing and dispensing a plurality of tickets utilizing a ticket dispenser which includes:

a dispenser body defining an internal chamber for receiving a roll of paper web, a lid for the body, the lid being movable between a closed and an open position with respect to said chamber, an external ticket receiving surface, upright means on the body defining a substantially upright support surface, drum means mounted on the lid such that, when the lid is in its closed position, the drum means rests against said support surface, drive means for rotating said drum means such that, when a paper web from a roll of paper web within said chamber passes between the drum means and the support surface, rotation of the drum means causes the paper web to advance, the lid having a substantially upright wall portion with an upper edge, the wall portion being positioned above, generally parallel with, but offset with respect to said support surface when the lid is closed, such that a portion of paper web coming from between the drum means and the support surface is offset from the upright wall portion, a relatively stiff deflector means supported from said body and having an operative deflector surface adapted and oriented so as to deflect toward the ticket receiving surface any portion of the paper web rising beyond said edge, a relatively flexible retainer supported from said body and resting against the upright wall portion and a cutting means for the web, said method comprising the steps:

advancing the paper web between the drum and the upright support surface by rotating said drum, then severing the web with the cutting means to separate a ticket from the web, while retaining the ticket against the upright wall portion utilizing the flexible retainer strip, each ticket having a leading and a trailing edge, then raising the said ticket by advancing the leading edge of the next sequential web portion until it is urged by the retainer into overlapping, gripping relation with the trailing edge of the previous ticket, then deflecting the first-mentioned ticket around said upper edge toward the ticket receiving surface with said relatively stiff deflector means, whereupon, when the latter ticket leaves the grip of the retainer, it can fall down onto the ticket-receiving surface or on previously dispensed tickets.

Further, this invention provides in a paper dispensing mechanism to dispense a paper web from a roll and including a housing having a chamber to accommodate said roll and a drive to advance said paper web from said roll thereby to dispense said paper web, said paper web being of a light colour and having red markings thereon adjacent the end of the roll, the improvement comprising;

a paper low level sensor in said chamber including a green light source to direct light onto said paper web and a light detector to detect changes in light reflected by said paper web as a result of said markings thereby to sense a low level paper condition.

Finally, this invention provide a paper low level sensor for a paper dispensing mechanism of the type to dispense a paper web from a roll to detect red markings on said paper web adjacent the end thereof comprising:

a green light source to direct light onto said paper web; and a light detector to detect changes in light reflected by said paper web as a result of said markings thereby to sense a low paper condition.

GENERAL DESCRIPTION OF THE DRAWINGS

One embodiment of this invention is illustrated in the accompanying drawings, in which like numerals denote like parts throughout the several views, and in which.

Figure 1:
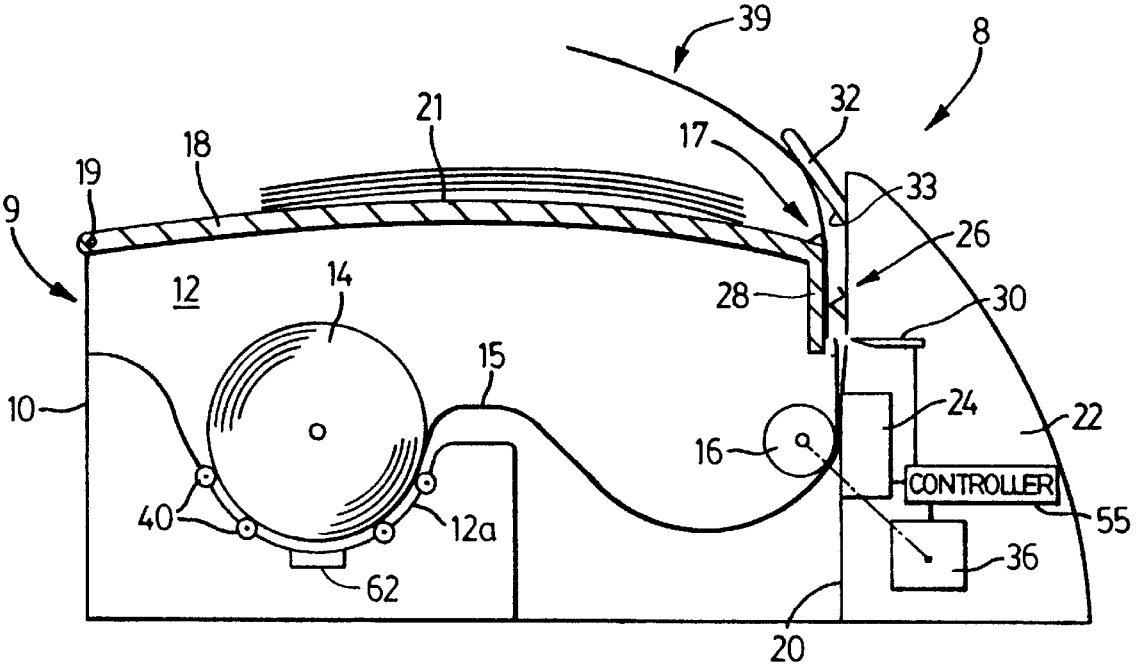
FIG. 1 is a schematic, vertical sectional view through the ticket dispenser of this invention illustrating the general location of the major features.
Figure 2:
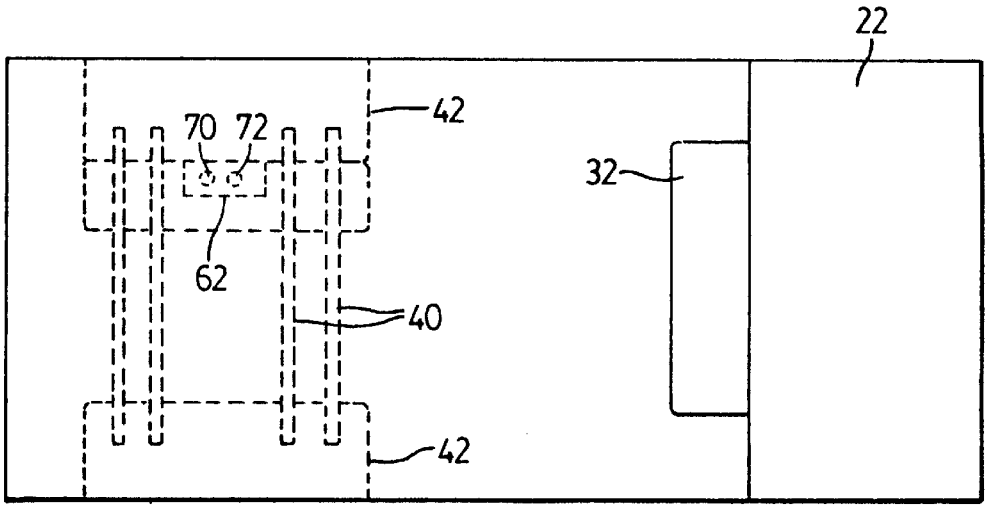
FIG. 2 is a plan view of the ticket dispenser of FIG. 1.
Figure 3:
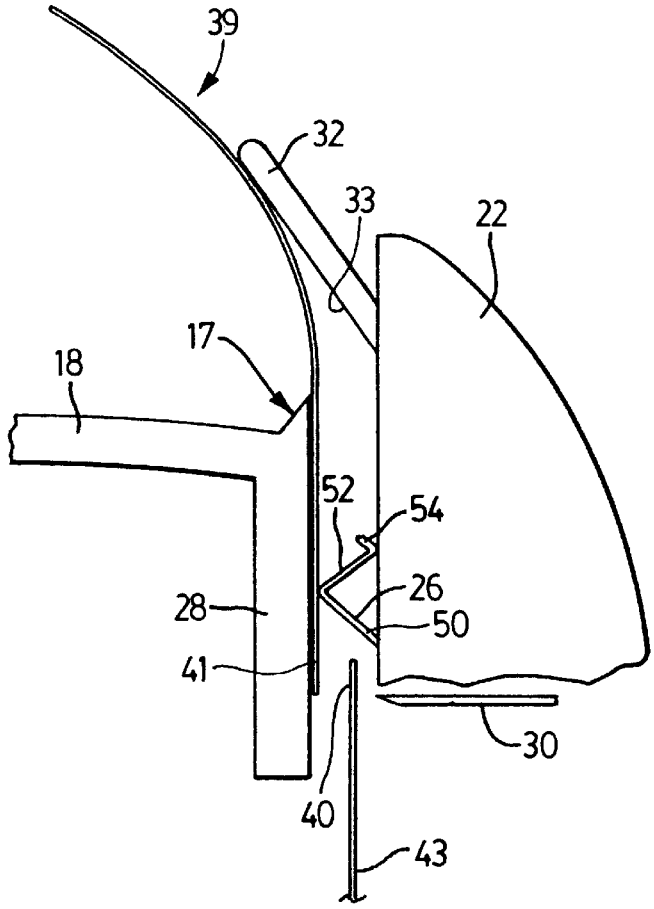
Figure 3A:
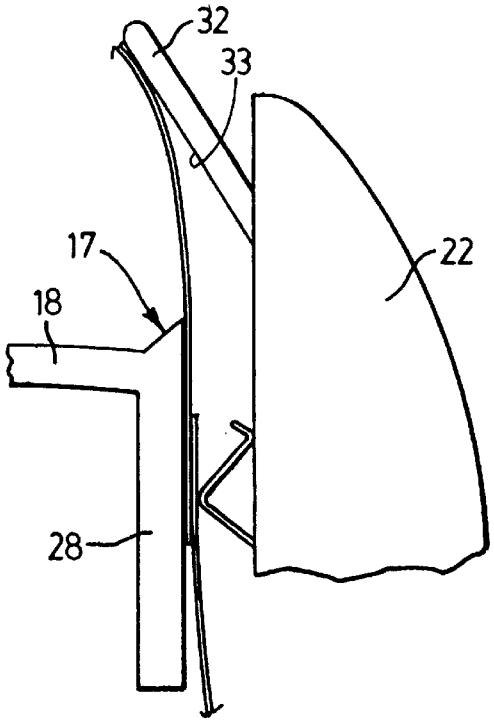
Figure 4:
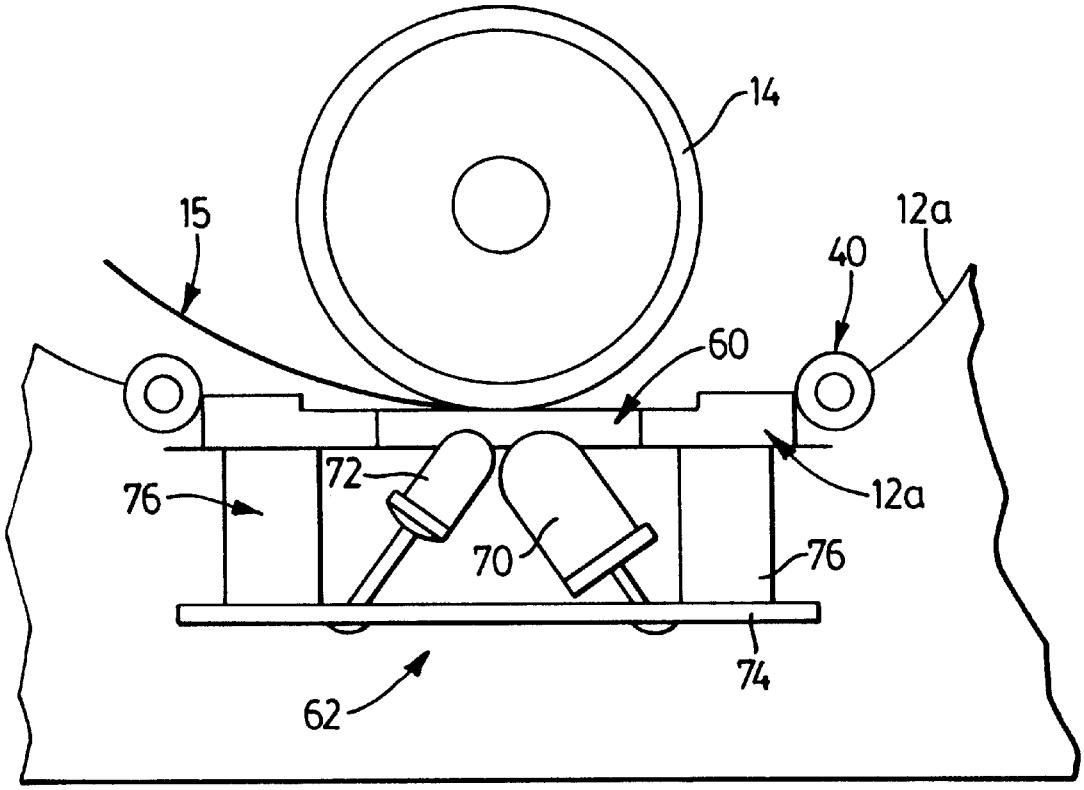
Figure 5:
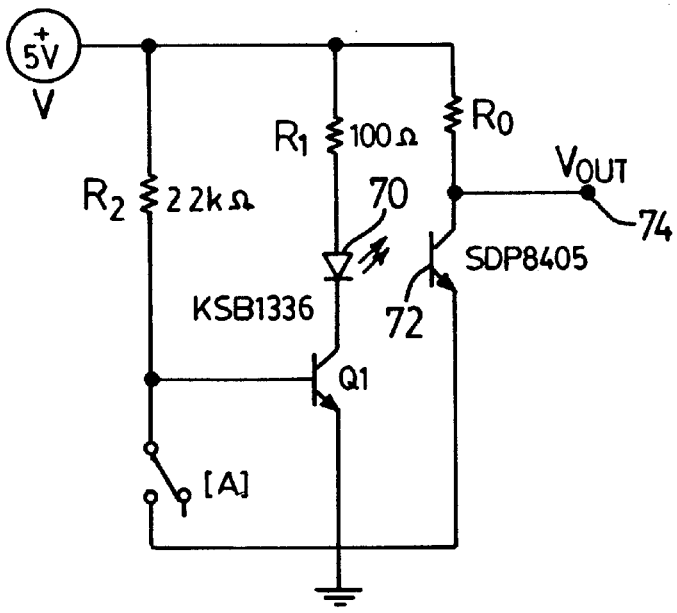

FIGS. 3 and 3*a* are detailed drawings of a portion of the ticket dispenser shown in FIG. 1, to a larger scale than FIG. 1;

FIG. 4 is a detailed drawing of another portion of the ticket dispenser shown in FIG. 1, to a larger scale than FIG. 1; and FIG. 5 is a schematic circuit diagram of a paper low sensor forming part of the dispenser of FIG. 1.

DETAILED DESCRIPTION OF THE PREFERED EMBODIMENT

Referring first to FIG. 1, there is provided a ticket dispenser 8 having a housing 9 including a dispenser body 10 which defines an internal chamber 12 adapted to receive a roll 14 of paper web 15 on which the tickets to be dispensed are printed.

The body 10 defines upright means in the form of a substantially upright support surface 20. The paper web 15 from the roll 14 is fed between the drum 16 and the support surface 20 such that, when the drum 16 is rotated, the paper web is advanced. The drum 16 is rotated by a motor 36 within the body through a transmission (not shown).

A print head 24, mounted on the body adjacent the drum 16, prints the appropriate ticket information on the paper web.

The lid 18, pivotally mounted to the body 10 about a pivot axis 19, also incorporates a substantially upright wall portion 28 which is positioned above, generally parallel with, but inwardly (leftwardly) offset from the support surface 20 when the lid 18 is closed, such that a portion of paper web coming from between the drum 16 and the support surface 20 can pass in spaced relation along the upright wall portion to the edge 17. The edge 17 is located adjacent the upper ticket receiving surface 21 of the lid 18.

The body 10 supports a deflector 32 having a deflector surface 33 which is adapted to deflect, toward the ticket receiving surface 21, any portion of the paper web 15 which rises upwardly beyond the edge 17.

The body 10 also supports a relatively flexible retainer strip 26, which contacts any portion of the paper web 15 which is adjacent the operative surface of the upright wall portion 28 on the lid 18.

More particularly, and as is well illustrated in FIGS. 3 and 3*a*, the flexible retainer strip 26 is supported from the portion 22 of the body 10. The strip 26 includes a first flank 50, which is integral with a second flank 52 through a right-angle bend. The second flank 52 terminates in a small ledge 54, which provides a Z-shaped profile for the strip 26. The particular angulation of the first flank 50 provides a "funneling" function, which ensures that the rising leading edge of the web will be trapped between the wall portion 28 and the flexible retainer strip 26.

The numeral 30 schematically represents a cutting device, for example a blade, which cuts the paper web 15 after a ticket has been printed. A controller 55 within the body 10 communicates with the motor 36, print head 24 and the cutting device 30 to synchronize operation of the ticket dispenser.

In operation, imagine firstly that the paper web 15, not yet cut by the cutting device 30, extends upwardly from between the drum 16 and the support surface 20, with the leading end projecting upwardly and being deflected leftwardly by the deflector 32. For example, looking at FIG. 3, prior to being severed, the upper end 40 would still be connected integrally with the rearward edge 41. Then, the cutting device 30 severs the web into two pieces, as drawn in FIG. 3. Next, the portion below the line of cutting, shown at 43 would move upwardly. FIG. 3 shows the situation shortly after this upward movement has begun. It will be seen that the leading edge 40 of the web portion 33 is "aimed" at the flank 50 of the retainer strip 26. Due to the angulation of the flank 50, the leading edge 40 of the portion 43 will be forced leftwardly as it continues to rise, thus becoming trapped between the retainer strip 26 and the upstream portion, previously cut from the web. Further motion would cause the rising part 33 to overlap the previously cut portion, as illustrated in FIG. 3*a*. A point would be reached at which the frictional drag between the two parts of the web would suffice to entrain the downstream part along with the "new" part, thus ejecting the ticket from the ticket dispenser. The cycle would then repeat, with sequential tickets being printed and severed, and with each printed and severed ticket being urged out of the ticket dispenser by frictional contact with the next ticket in sequence.

During operation, when tickets are to be printed and dispensed from the ticket dispenser, the drum 16 is rotated to unwind the paper web 15 from the roll 14. The paper web passes between the drum 16 and the support surface 20 and is urged upwardly by the drum rotation. As the paper web passes the drum 16, the print head 24 prints the ticket information on the side of the paper web which is directed away from the drum 16. As aforesaid, once the ticket has been printed, the cutting blade 30 operates to cut the paper web and thereby separate a ticket from the paper web. The bottom portion of the ticket is held in a vertical orientation by the flexible retainer strip 26, which pins the bottom portion of the ticket against the wall portion 28 of the lid 18, until the next ticket achieves a frictional overlap grip which ejects the first ticket from the dispenser, whereupon it falls against the lid (or on top of previous tickets that have been printed, ejected and stacked).

The remainder of the ticket can be seen extending out of the dispenser, as identified by the arrow 39, being deflected leftwardly toward the ticket receiving surface 21 by the deflector surface 33.

Attention is now directed to the internal chamber 12, which holds the roll 14 of paper web. The internal chamber 12 includes a curved support surface defining a barrel 12*a* to accommodate the roll 14. Barrel rollers 40 are accommodated within openings in the barrel 12*a* at spaced location to facilitate unwinding of the roll and reduce friction associated with heavy rolls 14 thereby to obviate the need for a spindle to support the roll. An opening 60 is provided at the bottom of the barrel 12*a* and accommodates a paper low sensor 62 (best seen in FIGS. 4 and 5). The paper low sensor 62 detects standard red markings placed along one side of the paper web 15 at the end of the roll 14.

Paper low sensor 62 includes a green light emitting diode (LED) 70 and a phototransistor 72. The LED and phototransistor are positioned on a support 74 suspended from the barrel 12*a* by a pair stands 76 glued to its undersurface. The LED 70 and phototransistor 72 are positioned approximately 1 mm below the roll 14 corresponding generally to the focal point of the LED. The LED 70 and phototransistor 72 are angled towards one another with their axial angles forming an angle equal to approximately 70°.

The emitter of the phototransistor 72 is coupled to ground while its collector is connected to a sensor output node 74 leading to the controller 55 and to a pull-up resistor RP. LED 70 is connected to a resistor R1 and to the collector of a transistor Q1. The emitter of transistor Q1 is connected to ground while its base is connected to a resistor R2 and to a switch A1. The resistors RP, R1 and R2 are also coupled to a voltage source V.

During operation, a 25 mA current is maintained through the LED 70 causing it to illuminate the edge of the roll 14 as the paper web 15 is unwound. When unmarked white paper passes above the paper low sensor 62, the green light emitted by the LED 70 is highly reflected toward the phototransistor 72 reducing the effective resistance of the phototransistor 72 resulting in a low voltage appearing at the sensor output node 74. However, when red marked paper passes above the paper low sensor 62, the green light is reflected toward the phototransistor 72 to a lesser extent. The effective resistance of the phototransistor 72 therefore increases resulting in an increased voltage at the sensor output node 74. The increased voltage at the sensor output node 74 is detected by the controller 55 and used to drive an indicator (not shown) on the exterior of the housing to signify a low paper condition. If desired, a higher amperage pulsed current can be supplied to the LED 70 to improve the sensitivity of the paper low sensor 62.

If desired, the body may also includes an adjustable side wall 42 to allow narrower rolls of paper to be accommodated within the internal chamber 12.

It will thus be recognized that the present development provides a ticket dispenser which dispenses tickets sequentially and stacks them in a horizontal manner on top of the dispenser, with the printed information facing upwardly, and with the latest ticket being located on top of the stack.

There is also provided a passive mechanism for maintaining the lower portion of the most recent ticket printed within the ticket dispenser, in a generally vertical disposition, so that when the next ticket is printed and advanced, the latter contacts the previously printed ticket and ejects it from the ticket dispenser. Although the passive mechanism is described as being in the form of a flexible retainer strip, those of skill in the art will appreciate that other retainer configurations can be used.

While one embodiment of this invention has been illustrated in the accompanying drawings and described hereinabove, it will be evident to those skilled in the art that changes and modifications may be made without departing from the essence of this invention, as set for the in the appended claims.

We claim:

1. A ticket dispenser comprising:

a housing defining an internal chamber for receiving a roll of paper web and having an upper ticket receiving surface, at least one side wall of said chamber being moveable to reduce the width of said chamber to accommodate different sized rolls;

a paper web guide to direct a paper web unwound from a roll in said chamber along a generally vertical path toward said ticket receiving surface, said paper web guide including a substantially upright wall portion with an upper edge and a passive retainer mechanism acting on said paper web so as to retain against the upright wall portion, any part of the paper web advancing along said path;

a drive actuable to unwind said paper web from said roll and advance said paper web along said path;

a cutting mechanism for cutting the paper web into discrete tickets; and a deflector oriented so as to deflect toward the ticket receiving surface any portion of the paper web rising beyond said edge.

2. A ticket dispenser as defined in claim 1 wherein said passive retainer mechanism is in the form of a resilient strip having a constant profile.

3. A ticket dispenser as defined in claim 2 wherein said deflector has an operative deflector surface extending above said ticket receiving surface and oriented so as to deflect toward the ticket receiving surface, the paper web rising beyond said edge.

4. A ticket dispenser as defined in claim 2 further including a print head to print information on said paper web.

5. A ticket dispenser as defined in claim 4 wherein said drive includes a drum and a motor to rotate said drum, said drum being positioned adjacent an upright support surface laterally offset from said upright wall portion and forming part of said path, said paper web passing between said drum and said upright support surface and being advanced along said path when said drum is rotated.

6. A ticket dispenser as defined in claim 5 wherein said print head is positioned adjacent said drum.

7. A ticket dispenser as defined in claim 6 wherein said housing includes a body and a lid for said body, said lid being movable between a closed and an open position with respect to said chamber and defining said external ticket receiving surface.

8. A ticket dispenser as defined in claim 7 wherein said drum is carried by said lid and is positioned adjacent said upright support surface when said lid is in said closed position.

9. A ticket dispenser as defined in claim 1 wherein said chamber includes a support surface defining a barrel accommodating said roll, said barrel having a plurality of rollers to reduce friction between said roll and said chamber as said paper web is advanced.

10. A ticket dispensing mechanism comprising:

a drive receiving sheet material from a supply and advancing said sheet material;

a printer to print ticket information on the sheet material thereby to form a succession of printed tickets, each printed ticket having a leading end; and a retaining mechanism receiving each printed ticket advanced by said drive in succession, said retaining mechanism holding each printed ticket in a manner such that the leading end of each successive printed ticket advanced by said drive contacts and ejects the printed ticket held by said retaining mechanism prior to itself being held by said retaining mechanism.

11. A ticket dispensing mechanism as defined in claim 10 further including a guide to guide each printed ticket as it is advanced by said drive such that the leading end of the printed ticket being advanced, contacts and ejects the printed ticket held by said retaining mechanism.

12. A ticket dispensing mechanism as defined in claim 11 wherein said retaining mechanism presses the printed ticket held thereby against a generally planar surface.

13. A ticket dispensing mechanism as defined in claim 12 wherein said retaining mechanism includes a resilient flexible retainer strip, each printed ticket passing between said retainer strip and said surface and being pressed against the surface by said retainer strip.

14. A ticket dispensing mechanism as defined in claim 13 wherein said retainer strip includes a flank to deflect the leading end of each printed ticket toward the surface as each printed ticket is advanced by said drive so that the printed ticket frictionally overlaps with the printed ticket held by said retaining mechanism thereby to constitute said guide.

15. A ticket dispensing mechanism as defined in claim 14 wherein said retainer step has a substantially constant Z-shaped profile.

16. A ticket dispensing mechanism as defined in claim 12 wherein said supply of sheet material is in the form of a web, said ticket dispensing mechanism further including a cutting device to cut said web after said web has been printed and advanced to said retaining mechanism thereby to form said printed ticket.

17. A ticket dispensing mechanism as defined in claim 11 further including a deflector to deflect each printed ticket ejected from said retaining mechanism onto a ticket receiving surface.

18. A ticket dispensing mechanism as defined in claim 17 wherein said ticket dispensing mechanism is disposed in a housing having a body and a lid, an upper surface of said lid constituting said ticket receiving surface.

19. A ticket dispensing mechanism as defined in claim 18 wherein said lid carries a flange, said flange being positioned adjacent said retaining mechanism and defining said surface.

20. A ticket dispenser comprising:

a housing defining an internal chamber for receiving a roll of paper web;

a drive receiving said paper web and advancing said paper web when a ticket is to be formed;

a printer to print ticket information on said paper web as it is advanced by said drive;

a retaining mechanism receiving the printed paper web advanced by said drive; and a cutting device to cut said paper web after said paper web has been printed and advanced to said retaining mechanism thereby to separate tickets in succession from said paper web, wherein said retaining mechanism holds each ticket in succession and guides said paper web in a manner such that when the paper web is advanced by said drive during formation of a successive ticket, a leading end of the paper web contacts and ejects the ticket held by said retaining mechanism from said housing.

21. A ticket dispenser as defined in claim 20 wherein said housing includes a lid defining an upper ticket receiving surface and a deflector to deflect each ticket ejected from said retaining mechanism onto said ticket receiving surface.

22. A ticket dispenser as defined in claim 20 wherein said paper web frictionally overlaps with the ticket held by said retaining mechanism to eject the ticket held by said retaining mechanism as said paper web is advanced.

23. A ticket dispenser as defined in claim 22 wherein said retaining mechanism presses each ticket held thereby against a generally planar surface.

24. A ticket dispenser as defined in claim 23 wherein said retaining mechanism includes a flexible, resilient retainer strip to press each ticket held thereby against said surface, said retainer strip including a flank to deflect and guide the leading end of said paper web towards the surface.

25. A ticket dispenser comprising:

a housing including a body defining an internal chamber for receiving a roll of paper web and a lid for said body, said lid being moveable between a closed position and an open position to expose said internal chamber and having an upper ticket receiving surface;

a paper web guide to direct a paper web unwound from a roll in said internal chamber along a generally vertical path towards said ticket receiving surface, said paper web including a substantially upright wall portion with an upper edge and a passive retainer mechanism acting on said paper web so as to retain against the upright wall portion, any part of the paper web advanced along said path;

a drive actuable to unwind said paper web from said roll and advance said paper web along said path;

a cutting mechanism for cutting the paper web into discrete tickets; and a deflector orientated so as to deflect toward the ticket receiving surface, any portion of the paper web rising beyond said edge.

26. A ticket dispenser as defined in claim 25 wherein said passive retainer mechanism is in the form of a resilient strip having a generally constant profile.

27. A ticket dispenser as defined in claim 26 wherein said deflector has an operative deflector surface extending above said ticket receiving surface and oriented so as to deflect toward the ticket receiving surface, the paper web rising beyond said edge.

28. A ticket dispenser as defined in claim 25 further including a printhead to print information on said paper web.

29. A ticket dispenser as defined in claim 28 wherein said drive includes a drum and a motor to rotate said drum, said drum being positioned adjacent an upright support surface laterally offset from said upright wall portion and forming part of said path, said paper web passing between said drum and said upright support surface and being advanced along said path when said drum is rotated.

30. A ticket dispenser as defined in claim 29 wherein said printhead is positioned adjacent said drum.

31. A ticket dispenser as defined in claim 30 wherein said drum is carried by said lid and is positioned adjacent said upright support surface when said lid is in said closed position.

32. A ticket dispenser comprising:

a housing having a body and a lid, an upper surface of said lid constituting a ticket receiving surface;

a drive within said housing receiving sheet material from a supply and advancing said sheet material;

a printer within said housing to print ticket information on said sheet material thereby to form a succession of printed tickets, each printed ticket having a leading end; and a retaining mechanism receiving each printed ticket advanced by said drive in succession, said retaining mechanism holding each printed ticket in a manner such that the leading end of each successive printed ticket advanced by said drive contacts and ejects the printed ticket held by said retaining mechanism onto said ticket receiving surface prior to itself being held by said retaining mechanism.

33. A ticket dispenser as defined in claim 32 further including a guide to guide each printed ticket as it is advanced by said drive such that the leading end of the printed ticket being advanced, contacts and ejects the printed ticket held by said retaining mechanism.

34. A ticket dispenser as defined in claim 33 wherein said retaining mechanism presses the printed ticket held thereby against a generally planar surface.

35. A ticket dispenser as defined in claim 34 wherein each printed ticket advanced by said drive frictionally overlaps with the printed ticket held by said retaining mechanism to eject the printed ticket held by said retaining mechanism as said sheet material is advanced.

36. A ticket dispenser as defined in claim 35 wherein said supply of sheet material is a web, said ticket dispenser further including a cutting device to cut said web after each ticket has been printed.

37. A ticket dispensing mechanism to dispense printed tickets in succession, said ticket dispensing mechanism comprising:

a retaining mechanism receiving printed tickets to be dispensed in succession; and a drive to advance the printed tickets to said retaining mechanism and to dispense tickets from said retaining mechanism, wherein said retaining mechanism holds each printed ticket in succession in a manner such that a leading end of a successive printed ticket advanced thereto by said drive, contacts and ejects the printed ticket held by said retaining mechanism prior to said successive printed ticket being held by said retaining mechanism.

38. A ticket dispensing mechanism as defined in claim 37 wherein each successive printed ticket advanced to said retaining mechanism by said drive frictionally overlaps with the printed ticket held by said retaining mechanism thereby to eject the printed ticket held by said retaining mechanism as said successive printed ticket is advanced by said drive.

* * * * *